United States Patent [19]

Kosaka et al.

[11] 4,426,159

[45] Jan. 17, 1984

[54] ELECTRONIC TIME KEEPING DEVICE

[75] Inventors: Kazumitu Kosaka, Urawa; Yukio Kido, Fussa; Shigeru Katoh, Yamato; Hitoshi Tsutsui, Kokubunji, all of Japan

[73] Assignee: Casio Computer Co., Ltd., Tokyo, Japan

[21] Appl. No.: 366,230

[22] Filed: Apr. 7, 1982

Related U.S. Application Data

[63] Continuation of Ser. No. 100,734, Dec. 6, 1979, abandoned.

[51] Int. Cl.[3] ..... G04B 19/04; G04C 23/02

[52] U.S. Cl. ..... 368/80; 368/88

[58] Field of Search ..... 368/76, 80, 88, 155–157, 368/160, 203–204, 223, 276, 299

[56] References Cited

U.S. PATENT DOCUMENTS

| | | | |
|---|---|---|---|
| 3,052,082 | 9/1962 | Beyner et al. | 368/204 |
| 3,538,703 | 11/1970 | Walton | 368/80 |
| 3,999,369 | 12/1976 | de Valroger et al. | 368/204 |
| 4,079,582 | 3/1978 | Tamaru et al. | 368/76 |
| 4,092,820 | 6/1978 | Kume et al. | 368/69 |
| 4,201,040 | 5/1980 | Makayama | 368/204 |

FOREIGN PATENT DOCUMENTS

| | | | |
|---|---|---|---|
| 1058942 | 6/1959 | Fed. Rep. of Germany | 368/204 |

*Primary Examiner*—Vit W. Miska

*Attorney, Agent, or Firm*—Frishauf, Holtz, Goodman and Woodward

[57] ABSTRACT

An electronic time keeping device has a stepping motor including a rotor, a stator and coils mounted in unitary fashion. Hands of the minimum unit of time are mounted directly to the shaft of the stepping motor. Gear mechanisms, electronic parts and the like are accommodated in a depressed portion on the upper surface of the time keeping device.

9 Claims, 15 Drawing Figures

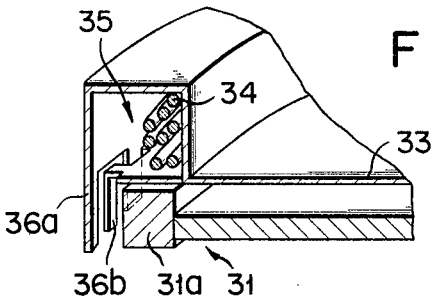
FIG. 4
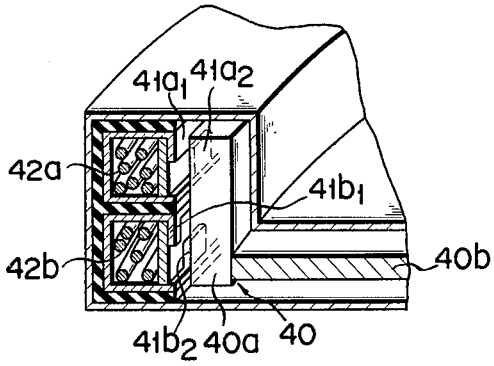
FIG. 5
FIG. 6
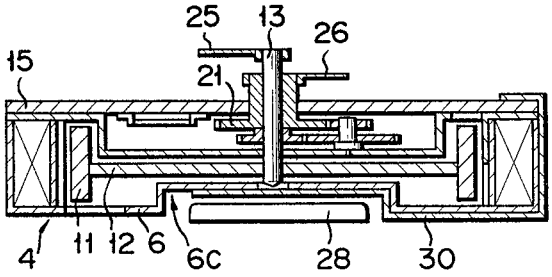

ELECTRONIC TIME KEEPING DEVICE

This is a continuation of application Ser. No. 100,734 filed Dec. 6, 1979, now abandoned.

BACKGROUND OF THE INVENTION

The present invention relates to an electronic time keeping device which displays the time of day by moving its hands by means of a stepping motor.

The electronic time keeping devices of this kind generally use a stepping motor with a small number of poles, for example, six poles or twelve poles, to make their size adequately small. They are so constructed that the rotor, stator and coil of the stepping motor are directly fixed on the ground plate and the driving force of the stepping motor shaft is transmitted to the second hand or the minute hand which is the minimum unit of time via a mechanical transfer means such as a grear-series mechanism and to the hour hand to drive it by way of another gear-series mechanism. The state of the art is such that the structure outlined above comprises many parts for mounting the pulsemotor and the gears and a complicated composition because it uses a ground plate to fasten and support the pulse motor and the gears and a pivotal receptacle plate for pivotally supporting the shafts, thereby making it necessary to aign the pivots (or bearings) on the ground plate with those on the receptacle plate when they are assembled and thus leading to high manufacturing cost and low productivity because of the onerous assembly work.

Further, the fact that the component parts such as cogwheels are tiny and thin makes the structure so delicate that it still has insufficient strength against an external shock and poor reliability. It should therefore be maintained carefully.

Accordingly, an object of the invention is to provide an electronic time keeping device which is small in size, light in weight, and low in cost, reduced in the number of parts, simplified in maintenance, and high in reliability.

SUMMARY OF THE INVENTION

To achieve the above object, an electronic time keeping device comprises a stepping motor rotatively driven by a reference clock pulse time indicating and hands the rotation of which are controlled by the stepping motor, in which said stepping motor is packed as a unit in a case covering the rotor, stator and coil of the stepping motor, and the case is provided with a depressed portion for receiving therein other components of the time keeping device.

With such construction, the number of parts is remarkably reduced, the assembling work is considerably improved, the maintenance is simplified, the reliability of the device is improved, the manufacturing cost is reduced, the gear-mechanism is minimized and made thin as a whole. Therefore, satisfactorily improved time keeping devices may be provided.

BRIEF DESCRIPTION OF THE DRAWING

FIG. 4 shows perspectively a cross section of another embodiment of the time keeping device according to the invention;

FIG. 5 shows perspectively a cross section of a major part of still another embodiment of the time keeping device according to the invention;

FIG. 6 shows a cross sectional view of the movement of the time keeping device according to the invention;

DETAILED DESCRIPTION

The preferred embodiments of the electronic time keeping device will be described in detail with reference to the accompanying drawings.

Figure 2:
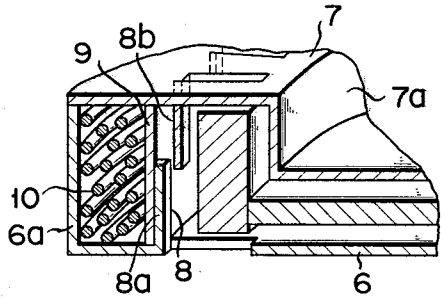
FIG. 2 shows perspectively a cross section of a major part of the pulse motor shown in FIG. 1.
Figure 1:
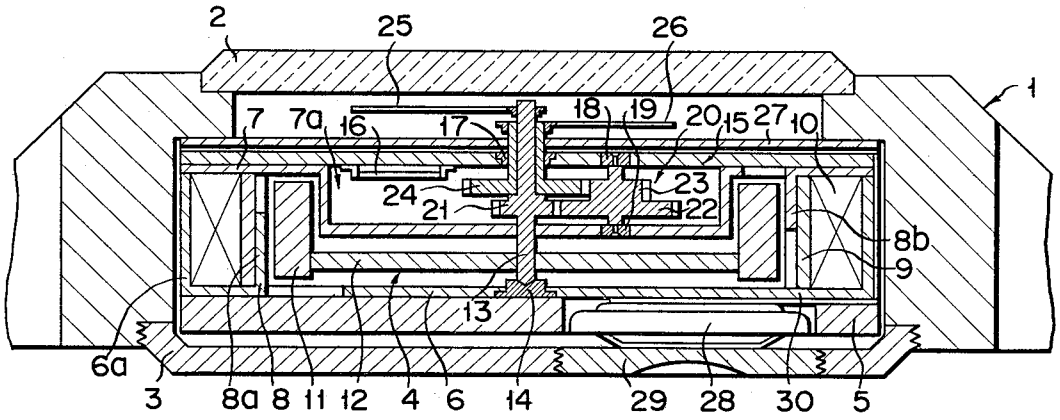
FIG. 1 shows a longitudinal sectional view of an electronic time keeping device according to the invention.
Figure 3:
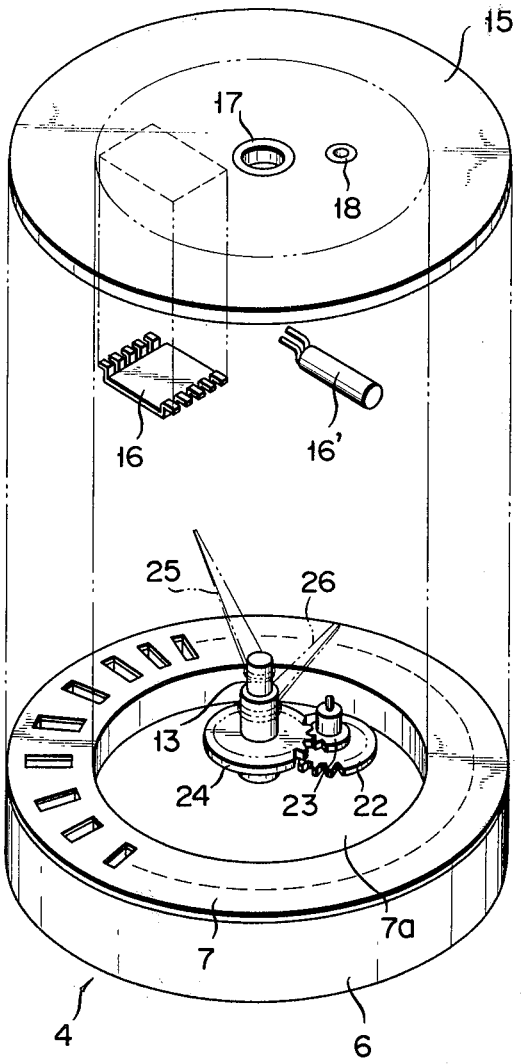
FIG. 3 shows an exploded view of a major part of the electronic time keeping device shown in FIG. 1.

FIG. 1 to FIG. 3 show one of the preferred embodiments of the present invention as employed in an electronic wrist watch using a 60-pole, 60-step pilse or stepping motor. FIG. 1 shows a cross section of the above electronic wrist watch, where reference numeral 1 denotes an outer casing of the wrist watch with a glass cover 2 fit in its front side opening and a back lid 3 screwed lightly into its rear side opening. Inside the outer casing 1 is located a 60-pole, 60-step pulse motor 4 so that it lies on an insulating base 5 as shown. A circular lower case 6 with an upright peripheral wall 6*a* on its perimeter is placed under a circular upper case 7 with a round concave or depressed portion 7*a* at its central part so that the two case members 6, 7 form a casement of the pulse motor. A number of stator segments 8*a*, . . . are placed vertically at certain intervals along the inner circumference of the annular coil space next inside of the peripheral wall 6*a* on the lower case 6. Similarly, a number of stator segments 8*b*, . . . are placed vertically at certain intervals along the same circumference on the lower face of the upper case 7 as the stator segments 8*a*, . . . are placed along so that the stator segments 8*a*, . . . and the stator segments 8*b*, . . . are located alternately to form the stator 8 as a whole. An insulating ring 9 is provided around the outer perimeter of the stator 8. The stator coil 10 made of copper wire is wound in the space between the insulating ring 9 and the circular wall 6*a* of the lower case 6. An annular rotor 11 is located between the stator 8 and the peripheral wall of the concave portion 7*a* of the upper case 7 so that the rotor 11 is encased by the bottom disc 6 and the top disk 7. The perimeter of the rotor 11 is divided into 60 equal parts which are given magnetic polarities that are north and south alternately. The rotor 11 is mounted on a rotor support 12 fitted to be perpendicular to the pulse motor shaft 13 at the center of the motor 4 as shown. The motor shaaft 13 extends from the center of the lower case 6 through the center of the concave or depressed portion *7a* of the upper plate 7 and penetrates a circuit board 15 to be described later, extending upwardly. This shaft is seated on a pivot 14 at the center of the lower case 6 so as to rotate freely. The circuit board 15 which is round and has the same diameter as the upper case 7 is superimposed on the upper case 7 so as to cover the hollow over the concave portion *7a* in the casing of the pulse motor. Thus, the circuit board 15 is so located that it forms a lamination with the pulse motor. The circuit board 15 has a printed circuit to perform the time keeping functions one of which is to drive the pulse motor 4. A LSI circuit 16 for the pulse motor 4, a crystal oscillator (not shown) and other electronic components are mounted on that surface of the circuit board 15 which faces the concave portion *7a* of the upper case 7. Further, the bearings to hold the shaft of the pulse motor and that of the gears are located on the circuit board 15. That is, a bearing 17 is placed at its center and a bearing 18 is provided near the bearing 17. The bearing 19 is located on the bottom of the concave portion *7a* of the upper case 7 so as to make it opposite to the bearing 18. There is a gear 20 in the space between the concave portion *7a* of the upper case 7 and the circuit board 15 laid on it. The gear 20 consists of a 1st gear 22 to mesh with a gear 21 formed on the middle of the motor shaft 13, a 2nd gear 23 formed togethe with the 1st gear 22 and 3rd gear (the hour hand gear) 24 to mesh with the 2nd gear 23. The axis of the 1st gear 22 and the gear 23 is in parallel with the motor shaft 13. The shaft of the 1st gear 22 and the 2nd gear 23 is pivoted to rotate freely at the bearing 18 on the circuit board 15 and at the bearing 19 on the concave portion *7a*. The motor shaft 13 extending through the circuit board 15 is inserted into the shaft of the 3rd gear 24 but kept free from it to rotate and the 3rd gear is held free to rotate by the bearing 17 on the circuit board 15. That is, the bearing 17 supports the motor shaft 13 and the 3rd gear 24, and the bearing 18 supports the 1st gear 22 and the 2nd gear 23. The minute hand 25 is mounted on the upper end of the motor shaft 13 extending beyond the circuit board 15. The hour hand 26 is mounted on he upper end of the shaft of the 3rd gear 24. In FIG. 1, 27 denotes a dial disc with time numerals and other indicia placed over the circuit board 15, 28 denotes a button battery placed in the insulaing base 5, 29 denotes the lid of the battery space put into the back lid 3, and 30 denotes a flexible lead to connect the battery 28 to the circuit board 15.

The pulse motor 4 shown perspectively and in cross section has the stator 8 of which the segments 8*a*, —and the segments 8*b*,—alternatingly turn their magnetic polarities as the direction of the current flow through the coil 10 alters. The rotor 21 comprises 60 equal portions which are alternately different in their magnetic polarities. Thus, pulse signals applied from the drive circuit on the circuit board 25 will rotate the pulse motor 4 stepwise at the rate of one step per minute. The motor shaft 13 makes one revolution in 60 minutes with 60 steps. The motor shaft acting as the shaft of the minute hand directly rotates the minute hand to point the time in minutes. The gear series 20 is to transmit the rotation of the pulsemotor 4 to the hour hand 26. The motion is transmitted from the gear 21 on the motor shaft 13 through the 1st gear 22 and the 2nd gear 23 to the 3rd gear 24 which rotates the hour hand 26 by 5 steps for each hour to indicate the time in hours.

FIG. 3 shows an exploded oblique view of the pulse motor 4 and the circuit board 15. The circuit board 15 with the bearings 17 and 18 in it is superimposed on the pulse motor 4 to make a lamination or layered structure. The bearings 17 and 18 in the circuit board 15 make possible to eliminate the need of at least either the ground plate or the pivotal receptacle plate that are traditionally used to provide the bearing for the motor shaft and gear shafts because they can support these shafts. That is, in consideration of the proximity between the pulse motor 4 and the gear series 20 in terms of location as well as function, the circuit board 15 is superimposed on the pulse motor 4 to form a laination and the circuit board 15 is provided with the bearings 17 and 18 for the motor shaft 13 and the shafts of the gear series in order to make it play the same role as the ground plate or the pivotal receptacle plate. Since circuit board 15 does not pose any restriction in assembly relative to the location of other compnets, it may be aligned with respect to the bearings 17 and 18 as the datum (so as to establish correct position of the motor shaft 13 and the gear shafts). Thus the circuit board 15 can be positioned easily and correctly when it is mounted because no other constraints exist except the positioning of the shafts leaving a wider tolerance for it. Further, in this embodiment, the combination of the concave portion *7a* and the circuit board 15 makes it possible to eliminate the need for the ground plate and the pivotal receptacle plate because the motor shaft 13 penetrates the concave portion *7a* of the upper case 7 and the bearing 19 is located in it so as to make it function as the ground plate or the pivotal receptacle plate. The use of the 60-pole, 60-step pulse motor 4 with its motor shaft 13 which directly moves the minute hand on it provides a stable time keeping function with high reliability and also makes it possible to eliminate the minute hand portion of the gear series contributing to simplification and miniaturization of the device. Since the pulse motor 4 is provided with the concave portion *7a* in the upper case, the gear series 20 and the electronic components of the circuit board 15 can be accommodated in the concave portion as part of the pulse motor, thereby helping design a timepiece even smaller in thickness. In this case, the gear series 20 may be made compact around themotor shaft 13 of the pulse motor 4 and the shafts of the gear series may be pivoted on the upper case 7 of the pulse motor 4.

FIG. 4 shows another embodiment where the pulse motor has a concave portion at its center. There is a channel 35 containing the exciting coil 34 on the periphery of a motor case 33 to cover the rotor 31. Stators 36*a* and 36*b* incorporated in the motor case 33 are so placed that they confront the magnet 31*a* of the rotor 31.

FIG. 5 shows still another embodiment of the pulse motor in which the stator is composed of two parts, one on top of the other, facing a magnet 40*a* of a rotor 40. Each of the two parts of the stator containing the exciting coils 42*a* and 42*b* has a U-shaped cross section made of metal with its edges alternately extending like sawteeth and bent so as to have the tips on one edge come close to those on the other. The number of the tips referred to as 41*a*1, 41*a*2, 41*b*1 and 41*b*2 is 15 each. The stators 41*a*1, 41*a*2, 41*b*1 and 41*b*2 are located alternatively and they are 6 degrees apart from each other.

Figure 7A:
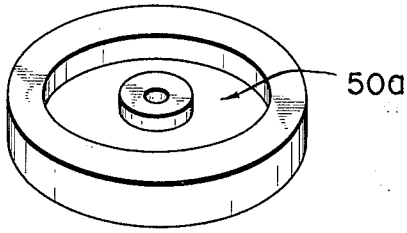
FIGS. 7(*a*), 7(*b*), 7(*c*) show perspective views of other embodiments of the pulse motor.
Figure 7B:
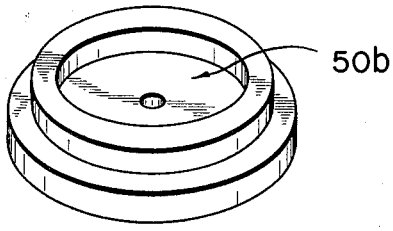
Figure 7C:
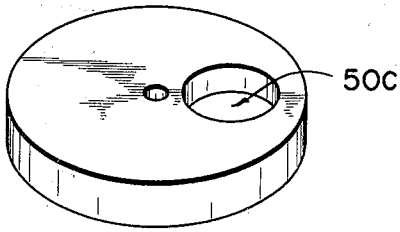

FIG. 6 shows that the concave portion of the pulse motor may be different in shape, position and size depending uppon the components to be placed in it. Thus, the bottom disc 6 may have a concave portion 6*c* to place the battery 28 in it. It is also possible to have a concave portion 50*a* in an area other than the center and the periphery of the motor case as shown in FIG. 7(*a*), to have a concave portion 50*b* in the area covering the center and the periphery of the motor case as shown in FIG. 7(*b*), and to have a small concave portion 50*c* between the center and the periphery of the motor case as shown in FIG. 7(*c*).

Figure 8:
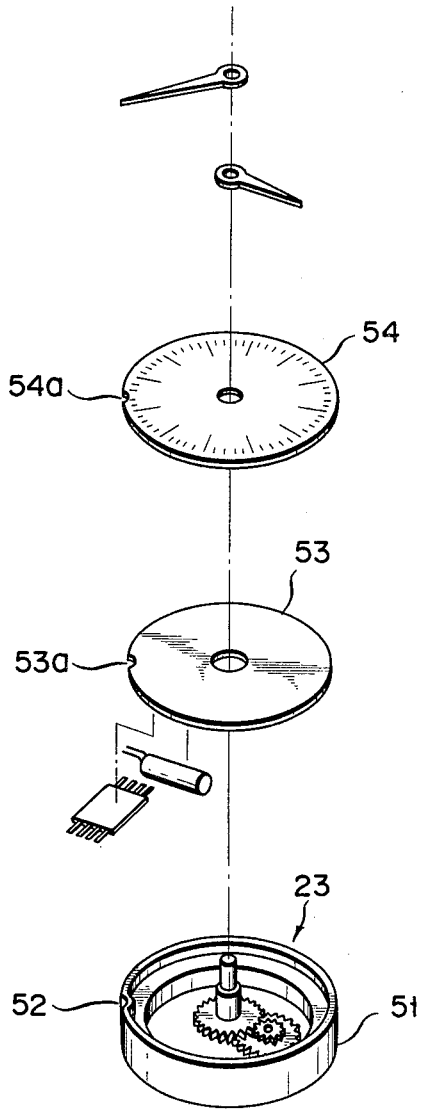
FIG. 8 shows an exploded view of a major portion of the electronic time keeping device according to the invention.

FIG. 8 illustrates another improved embodiment where a motor case 51 has a convex part 52 to engage with a concave part 53*a* of a circuit board 53 and the concave part 54*a* of a dial disc 54, thereby permitting easy alignment when they are assembled.

Figure 9:
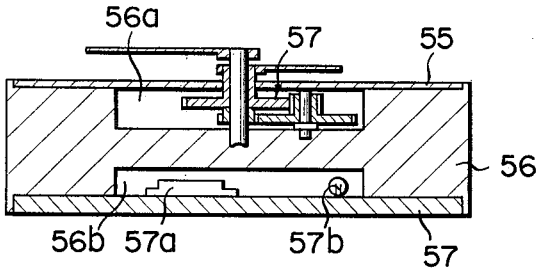
FIG. 9 shows a cross sectional view of a part of yet another embodiment of the time keeping device according to the invention.

FIG. 9 shows another embodiment of the present invention where a concave portion 56*a* is provided in the upper part of a pulse motor 56 located below a dial disc 55 so as to place a gear series 57 in the concave portion and the other concave portion 56*b* is provided in the lower part of the pulse motor so that electronic components 57*a* and 57*b* on the circuit board 57 are housed in said concave portion when the circuit board 57 is attached to the bottom of the pulse motor 56 to complete the assembly.

Figure 10:
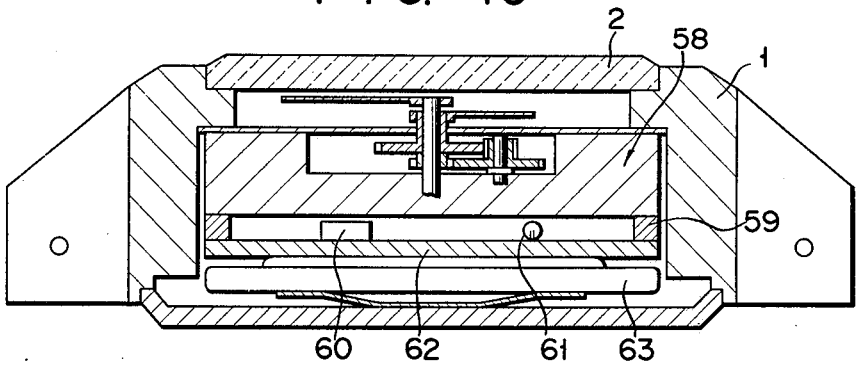
FIG. 10 shows a cross sectional view of a further embodiment of the time keeping device according to the invention.

FIG. 10 shows another embodiment when the circuit board is located beneath the pulse motor. A circuit board 62 on which an LSSI package 60 and a crystal oscillator 61 are mounted is placed below a pulse motor 58 with a spacer 59 between the two. It is so designed that a large battery, e.g. lithium battery, 63 is attached to the bottom of a circuit board 62.

Figure 11:
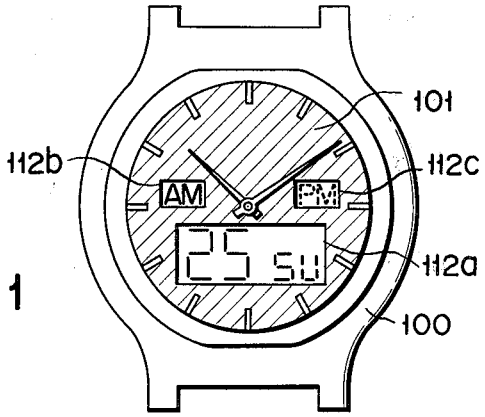
FIG. 11 shows a front view of the time keeping device which is another embodiment of the invention.
Figure 13:
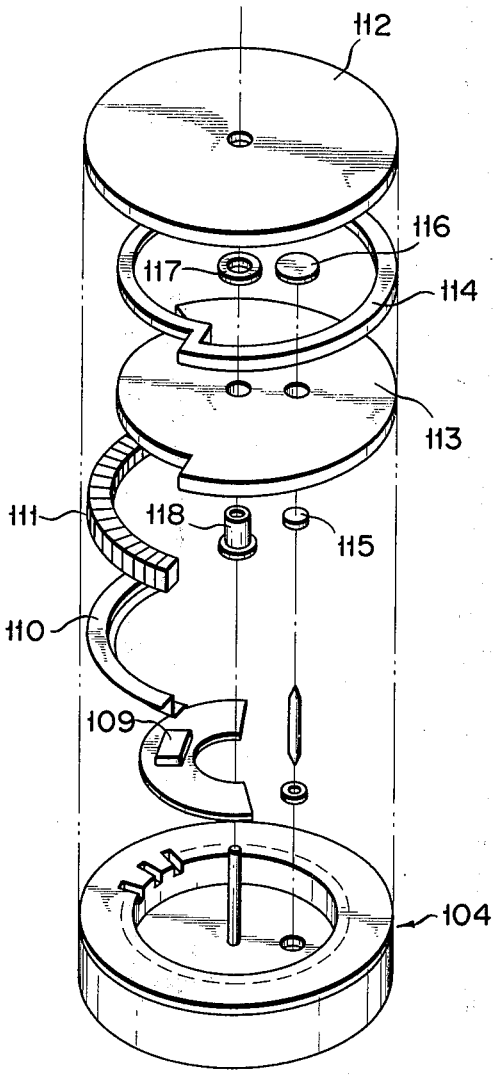
FIG. 13 shows perspectively an exploded view of the movement of the time keeping device shown in FIG. 11.

FIGS. 11 and 13 illustrate a preferred embodiment of the present invention where the time of day is indicated by the hands of a wrist watch and also by an optical display such as a liquid crystal display an or electrchronic display. FIG. 11 shows a front view of an electronic wrist watch to which this invention is applied.

Figure 12:
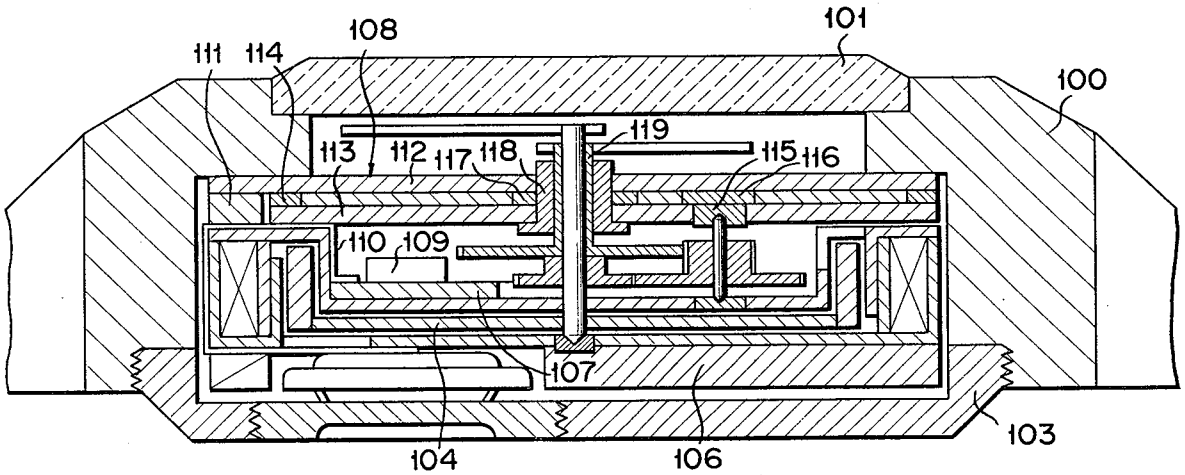
FIG. 12 shows a cross sectional view of the time keeping device shown in FIG. 11.

FIG. 12 shows a cross section of the electronic wrist watch and FIG. 13 is an exploded oblique view of the electronic wrist watch except for the internal gears. The following description will refer to FIGS. 11 to 13 in which reference numeral 100 denotes the casing of the watch whose front end is fitted with a watch glass 101 and whose rear end is fitted with a screwed back lid 103. In the casing 100 is provded a 60-pole, 60-step pulse motor 104 under which a plastic member to form the space for a battery 105 is located. The shape of the pulse motor 104 is the same as the pulse motor 4 shown in FIG. 1. A detailed description of the pulse motor is omitted here. A circuit board 107 is fitted with an LSI 109 which operates the pulse motor 104 and the liquid crystal display 108 to be explained later, the crystal oscillator (not shown) and other electronic components. Output signals to drive the liquid crystal produced by the LSI 109 are transmitted via a flexible wiring sheet 110 and a conductive elastic connector 111 to the liquid crystal display 108, which comprises a front base sheet 112 of transparent galss with an electrode (not shown) formed on it and a rear base sheet 113 of transparent glass with an electrode on it. The front base sheet 112 is laid on a spacer 114, which is placed on the rear base sheet 113, and liquid crystal is sealed inside the space between the sheets 112 and 113. The front base sheet 112 has an opaque coating on its surface except for the date and day of a week display area 112*a*, an AM display area 112*b* and a PM display area 112*c* so that it can serve as the dial disc. The rear base sheet 113 has a reflector (not shown) on its bottom and a clearance hole in it, through which a bearing 115 is located with a spacer 116 at its end to prevent it from touching the liquid crystal and deteriorating the liquid crystal. The liquid crystal display 108 has a clearance hole at its center penetrating the front base sheet 112, a spacer 117 and the rear base sheet 113. A bearing 118 is inserted in the clearance hole so as to allow the hour hand gear shaft 119 to rotate easily. The foregoing design of an electronic wrist watch enables its thickness to be small enough despite the use of the pointers as well as the optical display because it eliminates the need for the ground plate, pivotal receptacle plate and the like that are generally employed in the conventional electronic watches since the liquid crystal display 108 fitted with the bearings 115 and 118 is superposed on the pulse motor 104 with a concave portion to form a lamination so that the gear series and the circuit board 104 are lodged in the concave portion of pulse motor casing. The gear series may well be positioned to fit the gear shafts with the bearings embedded in the liquid crystal display 108. sthus, the assembly of the component parts has been made so simple that all that has to be done is to position the gear series, the circuit board 104 and the flexible wiring sheet 110 on the pulse motor 104 as requied, and place the liquid crystal display 108 followed by mounting of the hour hand and the minute hand.

Although the shaft of the pulse motor is fitted with the minute hand to directly rotate it in all the foregoing embodiments, the present invenion may be applied to a three-hand electronic watch by placing its second hand directly on the motor shaft. Further, the present invention may widely be applied to various electronic time pieces including portable clocks in addition to electronic wrist watches.

What we claim is:

1. An electronic time keeping device comprising:

an electronic circuit for generating reference clock signals;

a stepping motor coupled to said elctronic circuit and rotatively driven in a stepwise fashion in only one direction by said reference clock signals from said electronic circuit, said stepping motor including: a disc-like hollow motor casing having a recess at the center thereof and an outer peripheral wall surrounding at least said recess, said recess extending inwardly of said motor casing; a coil provided in said hollow motor casing alaong the inner surface of said outer peripheral wall of said motor casing and having a plurality of turns wound in a circumferential direction of said outer peripheral wall; a stator having a plurality of stator segments provided in said hollow motor casing interior of said outer peripheral wall of said motor casing and arranged in said circumferential direction of said outer peripheral wall; and a rotor disposed interior of said stator and having at least a part of said rotor arranged under said recess, whereby said coil, said stator and said rotor are covered by said motor casing and assembled in one unit;

time indicating hands; and a gear mechanism arranged in said recess of said motor casing and coupled to at least one of said time indicating hands for transmitting rotaion of said rotor of said stepping motor to said at least one of said time indicating hands.

2. The electronic time keeping device of claim 1, wherein said recess extends around the axial center of said disc-like hollow motor casing and terminates spaced from the outer peripheral wall of said hollow motor casing, the portion of said hollow motor casing between said recess and said outer peripheral wall defining an annular ringshaped portion of said hollow motor casing which extends axially of said recess, the innermost wall of said annular ring-shaped portion of said hollow motor casing corresponding to the outermost wall of said recess, said coil and stator segments being provided in said annular ring-shaped portion of said hollow motor casing and said portion of said rotor which is disposed interior of said stator is arranged in said annular ring-shaped portion of said hollow motor casing.

3. The electronic time keeping device of claim 1, wherein electrical parts of said electronic circuit are received in said recess.

4. The electronic time keeping device of claim 1, comprising a shaft coupled to said rotor of said stepping motor; and wherein one of said hands is directly coupled to said shaft.

5. The electronic time keeping device of claim 4, comprising a casing of said time keeping device for receiving said electronic circuit, stepping motor, hands and gear mechanism therein; and wherein the outer diameter of said motor casing of said stepping motor is substantially the same as the inner diameter of said casing of said time keeping device.

6. The electronic time keeping device of claim 1, comprising a casing of said time keeping device for receiving electronic circuit, stepping motor, hands and gear mechanism therein; and wherein the outer diameter of said motor casing of said stepping motor is substantially the same as the inner diameter of said casing of said time keeping device.

7. The electronic time keepingdevice of claim 1, wherein said electronic circuit comprises a circuit board and electronic component parts mounted on said cicuit board; and said circuit board is disposed on the motor casing of said stepping motor.

8. The electronic time keeping device of claim 1, wherein said stator of said stepping motor is formed integrally with said motor casing of said stepping motor.

9. The electronic time keeping device of claim 1, wherein said recess is located interior of said cell, said coil surrounding said recess and extending upwardly of said recess.

* * * * *

UNITED STATES PATENT AND TRADEMARK OFFICE

CERTIFICATE OF CORRECTION

PATENT NO. : 4,426,159

DATED : January 17, 1984

INVENTOR(S) : Kazumitu KOSAKA et al

It is certified that error appears in the above-identified patent and that said Letters Patent is hereby corrected as shown below:

COLUMN 1, line 46, change "pulse time indicating and" to --pulse and time indicating--;

line 47, after "stepping motor" change "," to -- . --;

line 48, delete "in which said" and insert --The--;

COLUMN 2, line 34, after "60-step" change "pilse" to --pulse--;

line 39, after "screwed" change "lightly to --tightly--;

COLUMN 3, line 47, after "placed in the" change "insulaing" to --insulating--;

COLUMN 5, line 34, after "crystal display" change "an or" to --or an--;

COLUMN 6, line 63, after "transmitting" change "rotaion" to --rotation--.

Signed and Sealed this

*Thirty-first* Day of *July 1984*

[SEAL]

*Attest:*

GERALD J. MOSSINGHOFF

*Attesting Officer*

*Commissioner of Patents and Trademarks*